US005711994A

United States Patent [19]

Powers

[11] Patent Number: 5,711,994

[45] Date of Patent: Jan. 27, 1998

[54] TREATED NONWOVEN FABRICS

[75] Inventor: Michael David Powers, Canton, Ga.

[73] Assignee: Kimberly-Clark Worldwide, Inc., Neenah, Wis.

[21] Appl. No.: 569,763

[22] Filed: Dec. 8, 1995

[51] Int. Cl.[6] ..... B05D 1/02; B05D 3/12

[52] U.S. Cl. ..... 427/255.6; 427/421; 427/296; 427/350

[58] Field of Search ..... 427/421, 422, 427/424, 427, 255.6, 296, 350; 8/115.54, 115.64, 149.1, 149.2

[56] References Cited

U.S. PATENT DOCUMENTS

| | | | |
|---|---|---|---|
| 836,336 | 11/1906 | Parker | 118/405 |
| 1,880,065 | 9/1932 | Arpin, Jr. | 118/30 |
| 1,919,798 | 7/1933 | MacLaurin | 118/314 |
| 2,110,052 | 3/1938 | Paasche | 118/325 |
| 2,146,809 | 2/1939 | Flint | 118/315 |
| 2,320,883 | 6/1943 | Parkinson | 118/325 |
| 2,342,536 | 2/1944 | Garrison | 118/315 |
| 2,672,844 | 3/1954 | Flint | 118/315 |
| 2,736,289 | 2/1956 | Allen | 118/48 |
| 3,338,992 | 8/1967 | Kinney | 264/24 |
| 3,341,394 | 9/1967 | Kinney | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,735,929 | 5/1973 | Pleines | 239/341 |
| 3,766,115 | 10/1973 | Sands | 260/29.15 B |
| 3,785,179 | 1/1974 | Davis et al. | 68/5 D |
| 3,802,817 | 4/1974 | Matsuki et al. | 425/66 |
| 3,849,241 | 11/1974 | Butin et al. | 161/169 |
| 3,855,046 | 12/1974 | Hansen et al. | 161/150 |
| 4,041,203 | 8/1977 | Brock et al. | 428/157 |
| 4,074,546 | 2/1978 | Roberson | 68/205 R |
| 4,270,913 | 6/1981 | Tse | 8/115.6 |
| 4,340,563 | 7/1982 | Appel et al. | 264/518 |
| 4,374,888 | 2/1983 | Bornslaeger | 428/198 |
| 4,412,505 | 11/1983 | Hausler et al. | 118/674 |
| 4,501,038 | 2/1985 | Otting | 8/151 |
| 4,547,406 | 10/1985 | Armstrong | 427/282 |
| 4,567,064 | 1/1986 | Woste | 427/157 |
| 4,631,933 | 12/1986 | Carey, Jr. | 66/192 |
| 4,810,411 | 3/1989 | Del Pesco et al. | 252/162 |
| 4,891,957 | 1/1990 | Strack et al. | 66/192 |
| 5,102,738 | 4/1992 | Bell et al. | 427/331 |
| 5,108,820 | 4/1992 | Kaneko et al. | 428/198 |
| 5,108,827 | 4/1992 | Gessner | 428/219 |
| 5,112,690 | 5/1992 | Cohen et al. | 427/40 |
| 5,169,706 | 12/1992 | Collier, IV et al. | 428/152 |
| 5,178,931 | 1/1993 | Perkins et al. | 428/198 |
| 5,336,552 | 8/1994 | Strack et al. | 428/224 |
| 5,382,400 | 1/1995 | Pike et al. | 264/168 |
| 5,389,202 | 2/1995 | Everhart et al. | 162/103 |
| 5,461,742 | 10/1995 | Pasad et al. | 8/149.2 |

FOREIGN PATENT DOCUMENTS

| | | |
|---|---|---|
| 0226687B1 | 9/1990 | European Pat. Off. . |
| 550029 | 7/1993 | European Pat. Off. . |
| 594983 | 5/1994 | European Pat. Off. . |
| 1339916 | 12/1973 | United Kingdom . |
| 2004773 | 4/1979 | United Kingdom . |
| 84/04704 | 12/1984 | WIPO . |

OTHER PUBLICATIONS

*Polymer Blends and Composites* by John A. Manson and Leslie H. Sperling, Plenum Press, New York, 1976, IBSN 0-306-30831-2, pp. 273-277, no month given.

*Primary Examiner*—Erma Cameron
*Attorney, Agent, or Firm*—William D. Herrick

[57] ABSTRACT

Improved method of treating nonwovens with a neat or nearly neat treating composition at least 90% by weight active ingredients by subjecting the nonwoven to a uniform concentration of said composition in an atomized form within a treating station. Drying and its potentially adverse effects are substantially eliminated.

6 Claims, 2 Drawing Sheets

TREATED NONWOVEN FABRICS

BACKGROUND OF THE INVENTION

Nonwoven fabrics and their manufacture have been the subject of extensive development resulting in a wide variety of materials for numerous applications. For example, nonwovens of light basis weight and open structure are used in personal care items such as disposable diapers as liner fabrics that provide dry skin contact but readily transmit fluids to more absorbent materials which may also be nonwovens of a different composition and/or structure. Nonwovens of heavier weights may be designed with pore structures making them suitable for filtration, absorbent and barrier applications such as wrappers for items to be sterilized, wipers or protective garments for medical, veterinary or industrial uses. Even heavier weight nonwovens have been developed for recreational, agricultural and construction uses. These are but a few of the practically limitless examples of types of nonwovens and their uses that will be known to those skilled in the art who will also recognize that new nonwovens and uses are constantly being identified. There have also been developed different ways and equipment to make nonwovens having desired structures and compositions suitable for these uses. Examples of such processes include spunbonding, meltblowing, carding, entangling and others, some of which will be described in greater detail below. The present invention has general applicability to nonwovens as will be apparent to one skilled in the art, and it is not to be limited by reference or examples relating to specific nonwovens which are merely illustrative.

It is not always possible to efficiently produce a nonwoven having all the desired properties as formed, and it is frequently necessary to treat the nonwoven to improve or alter properties such as wettability by one or more fluids, repellency to one or more fluids, electrostatic characteristics, conductivity, and softness, to name just a few examples. Conventional treatments involve steps such as dipping the nonwoven in a treatment bath, coating or spraying the nonwoven with the treatment composition, and printing the nonwoven with the treatment composition. For cost and other reasons it is usually desired to, use the minimum amount of treatment composition that will produce the desired effect with an acceptable degree of uniformity. It is known, for example, that the heat of an additional drying step to remove water applied with the treatment composition can deleteriously affect strength properties of the nonwoven as well as add cost to the process. It is, therefore, desired to provide an improved treatment process for nonwovens that can efficiently and effectively apply the desired treatment without adversely affecting desirable nonwoven web properties.

SUMMARY OF THE INVENTION

The present invention is directed to an improved method for effectively and efficiently treating nonwovens to impart one or more desired property and to the resulting improved nonwovens. The process of the invention includes subjecting one or both sides of the nonwoven to an atomized spray of neat or nearly neat treating composition under controlled conditions of a generally uniform atomized atmosphere. Drying and its deleterious effects are essentially or completely unnecessary, and the process provides means to uniformly treat one or both sides of the nonwoven to a desired degree. In accordance with the process of the invention, a nonwoven fabric is directed to a treating station where a treating composition that is less than about 10% solvent is directed as an atomized spray at the fabric within a treatment station providing controlled conditions and in an amount to effectively treat the area of the fabric contacted by the composition. The treated fabric may then be subjected to a similar treatment on the same or the opposite side and minimal drying, if necessary. Atomization is achieved, preferably, by nozzle sprayers designed for that purpose and operated so as to form a mist of a high degree of atomization. The resulting treated nonwovens have been shown to be uniformly and effectively treated with reduced composition requirements and minimal or no adverse effects. Preferred treatments include wettability and conductivity treatments for nonwovens for personal care and medical applications.

DETAILED DESCRIPTION OF THE INVENTION

Definitions

Figure 1:
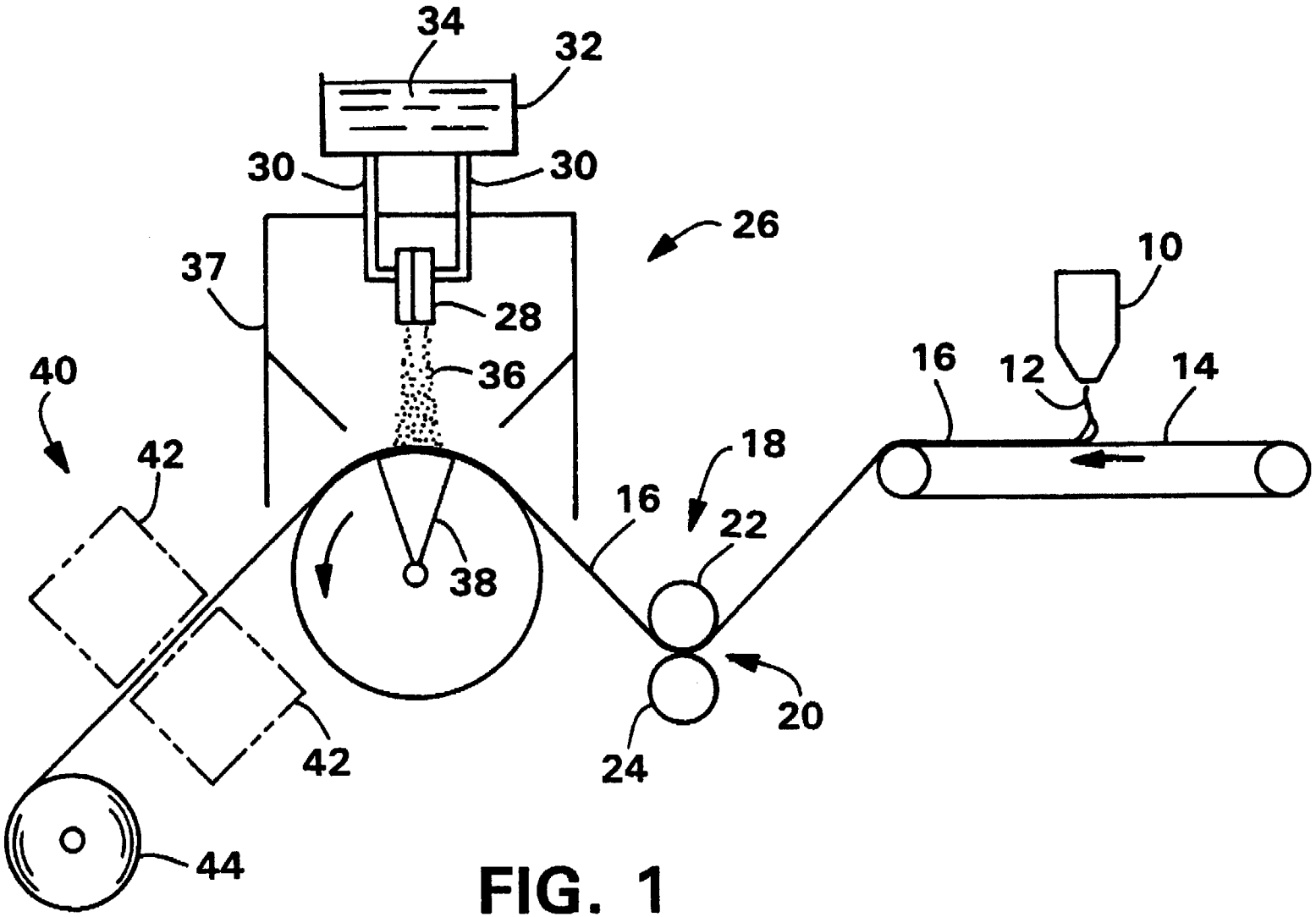
FIG. 1 is a schematic illustration of a treating process of the present invention useful for application to one side of the nonwoven web.

As used herein the term "nonwoven fabric or web" means a web having a structure of individual fibers or threads which are interlaid, but not in a regular or identifiable manner as in a knitted fabric. Nonwoven fabrics or webs have been formed from many processes such as for example, meltblowing processes, spunbonding processes, entanglement and bonded carded web processes. The basis weight of nonwoven fabrics is usually expressed in ounces of material per square yard (osy) or grams per square meter (gsm) and the fiber diameters useful are usually expressed in microns. (Note: to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times 0.89 \times 0.00707 = 1.415$). Outside the United States the unit of measurement is more commonly the "tex", which is defined as the grams per kilometer of fiber. Tex may be calculated as denier/9.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, U.S. Pat. No. 3,502,538 to Levy, and U.S. Pat. No. 3,542,615 to Dobo et al. Spunbond fibers are generally not tacky when they are deposited onto a collecting surface. Spunbond fibers are quenched and generally continuous and have average diameters larger than 7 microns, more particularly, between about 10 and 20 microns. They may be monocomponent, conjugate or biconstituent as described below.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin. Meltblown fibers are microfibers which may be continuous or discontinuous, are generally smaller than 10 microns in diameter, and are generally tacky when deposited onto a collecting surface.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

As used herein the term "monocomponent" fiber refers to a fiber formed from one or more extruders using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the vadous polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, through air bonding or "TAB" means a process of bonding a nonwoven bicomponent fiber web in which air which is sufficiently hot to melt one of the polymers of which the fibers of the web are made is forced through the web. The air velocity is between 100 and 500 feet per minute and the dwell time may be as long as 6 seconds. The melting and resolidification of the polymer provides the bonding. Through air bonding has restricted variability and is generally regarded a second step bonding process. Since TAB requires the melting of at least one component to accomplish bonding, it is restricted to webs with two components such as bicomponent fiber webs or added adhesive powders or fibers.

As used herein, the term "stitchbonded" means, for example, the stitching of a material in accordance with U.S. Pat. No. 4,891,957 to Strack et al. or U.S. Pat. No. 4,631,933 to Carey, Jr.

As used herein, "ultrasonic bonding" means a process performed, for example, by passing the fabric between a sonic horn and anvil roll as illustrated in U.S. Pat. No. 4,374,888 to Bornslaeger.

As used herein "thermal point bonding" involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. As in well known in the art, the spot bonding holds the laminate layers together as well as imparts integrity to each individual layer by bonding filaments and/or fibers within each layer.

As used herein, the term "personal care product" means diapers, training pants, absorbent underpants, adult incontinence products, and feminine hygiene products.

As used herein, the term "neat" means a composition of essentially 100% active ingredients without diluents or solvents.

Test Methods

Hydrohead: A measure of the liquid barrier properties of a fabric is the hydrohead test. The hydrohead test determines the height of water (in centimeters) which the fabric will support before a predetermined amount of liquid passes through. A fabric with a higher hydrohead reading indicates it has a greater barrier to liquid penetration than a fabric with a lower hydrohead. The hydrohead test is performed according to Federal Test Standard No. 191A, Method 5514.

Frazier Porosity: A measure of the breathability of a fabric is the Frazier Porosity which is performed according to Federal Test Standard No. 191A, Method 5450. Frazier Porosity measures the air flow rate through a fabric in cubic feet of air per square foot of fabric per minute or CSM. Convert CSM to liters per square meter per minute (LSM) by multiplying by 304.8.

Tensile: The tensile strength of a fabric may be measured according to the ASTM test D-1682-64. This test measures the strength in pounds and elongation in percent of a fabric.

A determination of wettability was made qualitatively by observing a small amount (about 10 cc) of water squirted onto a swatch (about 400 $cm^2$) of the fabric. If it was absorbed immediately, the fabric was wettable.

Alcohol Repellency: This test provides a rough index of the resistance of non-woven fabrics to penetration by alcohol and is particularly applicable when comparing various finishes on a given fabric. The effectiveness of alcohol-repellent finishes or treatments is determined by placing drops of specified percentages of isopropanol solutions on the surface of the sample and evaluating them after 5 minutes. Grading is by comparison with standard test rating photographs in accordance with INDA test method 80.9-74, revision '82.

It is also possible to have other materials blended with the polymer used to produce nonwovens which can be treated according to this invention like fluorocarbon chemicals to enhance chemical repellency which may be, for example, any of those taught in U.S. Pat. No. 5,178,931, fire retardants for increased resistance to fire and/or pigments to give each layer the same or distinct colors. Fire retardants and pigments for spunbond and meltblown thermoplastic polymers are known in the art and are internal additives. A pigment, if used, is generally present in an amount less than 5 weight percent of the layer while other materials may be present in a cumulative amount less than 25 weight percent.

The fibers from which the fabric treated in accordance with this invention is made may be produced by the meltblowing or spunbonding processes which are well known in the art. These processes generally use an extruder to supply melted thermoplastic polymer to a spinneret where the polymer is fiberized to yield fibers which may be staple length or longer. The fibers are then drawn, usually pneumatically, and deposited on a moving foraminous mat or belt to form the nonwoven fabric. The fibers produced in the spunbond and meltblown processes are microfibers as defined above.

The manufacture of meltblown webs is discussed generally above and in the references.

The fabric treated in accordance with this invention may be a multilayer laminate. An example of a multilayer laminate is an embodiment wherein some of the layers are spunbond and some meltblown such as a spunbond/meltblown/spunbond (SMS) laminate as disclosed in U.S. Pat. No. 4,041,203 to Brock et al., U.S. Pat. No. 5,169,706 to Collier, et al, and U.S. Pat. No. 4,374,888 to Bornslaeger. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.75 to about 3 osy (25 to 102 gsm).

Spunbond nonwoven fabrics are generally bonded in some manner as they are produced in order to give them sufficient structural integrity to withstand the rigors of further processing into a finished product. Bonding can be accomplished in a number of ways such as hydroentanglement, needling, ultrasonic bonding, adhesive bonding, stitchbonding, through-air bonding and thermal bonding as described herein and known to those skilled in the art.

The present invention is applicable to treatment with a wide variety of compositions. It is only essential that the composition be capable of atomization to the degree necessary to effectively treat the nonwoven. To determine suitability, the composition may be tested by Brookfield viscosity to have a viscosity generally less than 10,000 cp. Preferred compositions are those that have a viscosity of about 10,000 cps or less and especially about 1000 cp or less. Specific examples include TRITON X-102, an ethoxylated octyl phenol surfactant available from Union Carbide, AHCOVEL BASE N-62, a proprietary surfactant blend available from ICI Americas, Y12488 and Y12734, silicone surfactants available from OSi, ZELEC KC, an organic salt antistatic agent available from dupont, REPELLENT 7700, a fluorocarbon repellent agent available from dupont, MASIL SF-19, a silicone surfactant available from P.P.G. Industries, PEG 200, 400 and 600 series of fatty acid derivatives available from P.P.G. Industries, PERGASOL Blue, an organic blue dye available from Ciba Geigy, FC808, a fluorocarbon repellent agent available from 3-M Corporation, DISCOL 1627, a fluorocarbon repellent agent available from Calloway Chemical, T-MAZ-80, a surfactant available from P.P.G. Industries, and S-MAZ-80, a surfactant available from P.P.G. Industries.

Although the present invention is suitable for treating nonwovens broadly, it is most effective, and therefore preferred, for nonwovens having properties that lend them to high speed, efficient treatment. These properties include basis weight, porosity and tear strength. For example, extremely heavy nonwoven, above about 5 osy (170 gsm) may require very long treatment times, and lighter materials less than 3 osy (102 gsm) process faster. As indicated, porosity must be in a range that permits the treating fluid to permeate the web when other than surface treatment is desired. A Frazier porosity within the range of at least about 20 CFM and up to about 1500 CFM is believed generally useful.

In order to maximize the advantages of the present invention, the selection of the nonwoven and the treatment composition are preferably made so that the composition may be applied "neat" or with no more than 10% of a solvent, preferably water. Prior spray devices commonly cannot handle such high solids without adverse effects on uniformity and other properties.

The atomized composition is in extremely fine particle size form of up to 100μ in size, for example, which, in combination with the vacuum can be drawn into the interstices of the web providing very uniform and effective treatment throughout. Moreover, the reduction in bulk from the treatment is minimized as well with atomized particles. In general, particle size may be controlled by selection of viscosity of the treating composition and volume of atomizing air. Air at a pressure of 30 psi to 60 psi, especially 40 psi to 50 psi is preferred for fine atomized particles. Various atomizers may be used, such as those described in U.S. Pat. No. 4,270,913, which is incorporated herein by reference in its entirety. Referring to FIG. 1, an inline process will be described although it will be appreciated by those skilled in the art that the invention is equally applicable to a separate, off-line treatment step. Fiber former 10, for example a spunbond or meltblown die and associated fiber handling equipment, deposits fibers 12 onto a moving foraminous forming surface such as wire 14 forming web 16. Web 16 is carried to an optional bonding station 18 which may be, for example, nip 20 formed by calender rolls 22, 24. Web 16 is then directed to treatment station 26 that includes one or more atomizing nozzles 28 connected by conduit 30 to a reservoir 32 of treatment fluid 34. The treatment fluid 34 exits nozzles 28 as an atomized spray 36 directed against the web 16. Treatment station 26 is preferably enclosed as by means of walls 37 and baffles 39, and vacuum means 38 are provided to maintain a uniform concentration above web 16 and remove excess treating fluid which may be recycled if desired. When it is desired to uniformly distribute the treatment within the web, it is preferred that the volume of vacuum air exceed the volume of air output from the atomizing step. After exiting treatment station 26, web 16 may be directed to optional drying station 40 which may comprise one or more drying cans 42 shown in phantom and then wound as a roll 44 or converted to the use for which it is intended.

Figure 2:
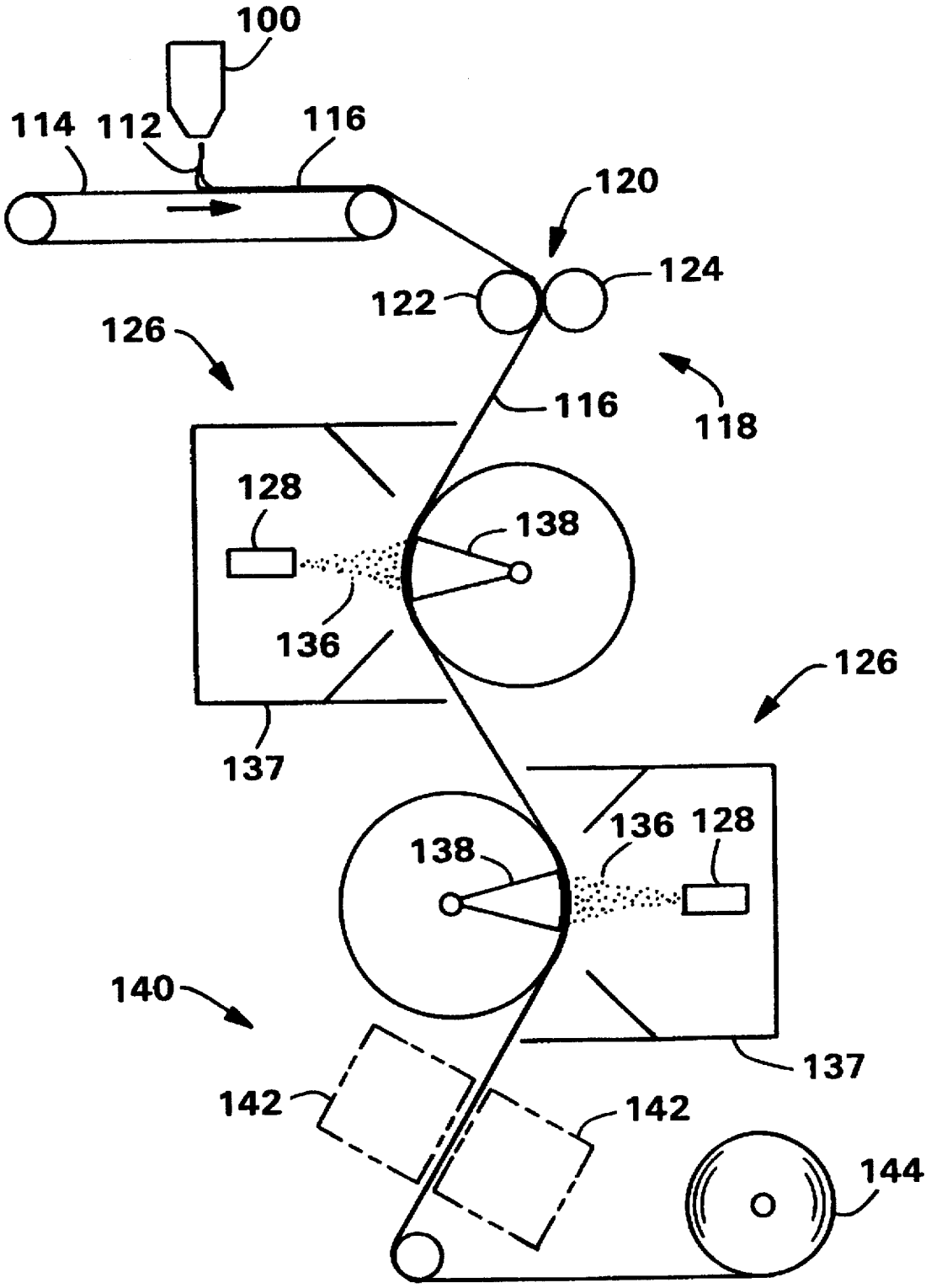
FIG. 2 is an illustration like FIG. 1 showing a process for application to both sides of the nonwoven web.

FIG. 2 is a sketch like FIG. 1 except that an additional treating station 126 including walls 137, nozzles 128, spray 136, and treatment fluid 134 are shown in position to treat web 16 on the side opposite that of that treated by treatment station 26. In this manner the same or different properties may be obtained for opposite sides of a nonwoven. In many cases, because of the highly uniform distribution resulting from the atomization of the treating composition, the treatment process of the present invention results in essentially equal treatment of both sides even if applied from one side only.

EXAMPLES

For these examples atomization was achieved using an AIRMIST™ nozzle #156.639.16.05 from Lechler which may be described as an external air mix, flat spray nozzle with external dimensions of 1 9/16 inches wide and 1 3/16 inches high that provides a high degree of atomization over a controlled area. The nonwoven described as SMS was a laminate of the type available from Kimberly-Clark Corporation including a middle meltblown layer of Exxon 3746G polypropylene having a basis weight of 10 gsm and an average fiber diameter of about 3.5 microns. On each side of the meltblown layer was a spunbond layer of Exxon 9355 polypropylene having a basis weight of 14 gsm and an average filament diameter of about 20 microns. The laminate was bonded by calendering between a patterned steel roll and an anvil roll to form a wire weave pattern of 48 bonds per $cm^2$ and a per cent bond area of about 16. Such laminates and their manufacture are described in Brock and Meitner U.S. Pat. No. 4,041,203 which is incorporated herein by reference in its entirety. The fabric identified as H was hydroentangled pulp and polypropylene (about 80% pulp) fabric having a basis weight of 90 gsm as available from Kimberly-Clark Corporation as HYDROKNIT® Fast Absorbing Material. Such fabrics and their manufacture are described in Everhart et al. U.S. Pat. No. 5,389,202 dated 14 Feb. 1995 which is incorporated herein by reference in its entirety. The fabric identified as SB was a spunbond polypropylene fabric having a basis weight of about 20 gsm basis weight as available from Kimberly-Clark Corporation. Such fabrics and their manufacture are described above and in numerous references listed above. When vacuum was applied, a HONEYCOMB™ roll, Model 1432, was used at a vacuum of 1 to 11 inches mercury. Table 1 below describes the examples and results obtained.

TABLE 1

| Example | Fabric | Composition | Add-on | Cure | Vacuum* | Results |
|---|---|---|---|---|---|---|
| 1 | SMS | Triton X-102 | 0.8–2% | No | 178–203 | Wettable |
| 2 | SMS | Masil SF-19 Neat | 0.8–2% | No | 178–203 | Wettable |
| 3 | SMS | Masil SF-19 Neat | 0.8–2% | No | 178–203 | Zoned wettable |
| 4 | SMS | Zelec KC Neat | 0.4–1.0% | No | 178–203 | Conductive (passed static decay at 0.01 sec.) |
| 5 | SMS | duPont 7700 Neat | 0.6–1.8% | 220° F. 1 min | 178–203 | Alcohol repellent 5's isopropanol (80%) |
| 6 | SMS | duPont 7700 at 28% | 0.17–.50% | 220° F. 1 min | 178–203 | Alcohol repellent 4's isopropanol (80%) |

TABLE 1-continued

| Example | Fabric | Composition | Add-on | Cure | Vacuum* | Results |
|---|---|---|---|---|---|---|
| 7 | SMS | duPont TLF8195 at 28% | 0.60–1.80% | 220° F. 1 min | 178–203 | Alcohol repellent 4's isopropanol (60%) |
| 8 | H | Pergasol Blue F-38 Neat | | | | Too blue |
| 9 | SB | Alcovel Base N-62 Neat | Target 2% | | 178–203 | Wettable |

*mm Hg
Triton X-102 is an ethoxylated octyl phenol surfactant.
Masil SF-19 is an organosilicone surfactant.
Zelec KC is an alkyl phosphate salt antistatic agent.
duPont 7700 is a proprietary fluorocarbon additive.
duPont TLF 8195 is a proprietary fluorocarbon additive.
Pergasol Blue F-38 is a phthalocyanine blue dye.

Thus, in accordance with the invention, there has been provided an improved treatment process and resulting treated nonwovens that provides the benefits described above. While the invention has been illustrated by specific embodiments, it is not limited thereto and is intended to cover all equivalents as come within the broad scope of the claims.

I claim:

1. Method of treating a web with a treatment agent to impart a desired property selected from the group consisting of wettability, conductivity, and repellency to said web comprising the steps of:

a. providing a source of said web;

b. providing said treatment agent at a treating station;

c. forming a mist of said treatment agent of at least 80% atomization and mist particle size up to about 100 microns at said treating station;

d. exposing said web to said mist at said treating station for a time period sufficient to add an amount of said treatment agent at a concentration of no more than 10% by weight solvent effective to impart said desired property to said web;

e. applying a vacuum to draw said particles into said web; and f. removing said web from said treating station.

2. The method of claim 1 wherein said treatment agent is provided as a neat composition.

3. The method of claim 1 wherein said web comprises a propylene polymer.

4. The method of claim 3 wherein said web comprises a nonwoven fabric.

5. The method of claim 4 wherein said treatment agent is selected from the group consisting of octyl phenol or organosilicone surfactants, phosphate salt antistatic agents, and fluorocarbon additives.

6. Method of treating a nonwoven fabric comprising a propylene polymer with a treatment agent to impart a desired property selected from the group consisting of wettability, conductivity and repellency to said nonwoven fabric comprising the steps of:

a. providing a source of said nonwoven fabric;

b. providing said treatment agent at a concentration of at least 90% by weight at a treating station;

c. forming a mist of said treatment agent of at least about 80% atomization and mist particle size up to about 100 microns at said treating station;

d. exposing said nonwoven fabric to said mist at said treating station for a time period sufficient to add an amount of said treatment agent effective to impart said desired property to said nonwoven fabric;

e. applying a vacuum to draw said particles into said nonwoven fabric; and f. removing said nonwoven fabric from said treating station.

* * * * *